US008419015B2

(12) United States Patent
Ota et al.

(10) Patent No.: US 8,419,015 B2
(45) Date of Patent: Apr. 16, 2013

(54) IMAGE RECORDING DEVICE

(75) Inventors: Yasuhira Ota, Yatomi (JP); Iwane Sano, Obu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/238,859

(22) Filed: Sep. 21, 2011

(65) Prior Publication Data

US 2012/0091650 A1 Apr. 19, 2012

(30) Foreign Application Priority Data

Sep. 21, 2010 (JP) ..... 2010-211096
Jan. 21, 2011 (JP) ..... 2011-011139

(51) Int. Cl.
*B65H 5/00* (2006.01)

(52) U.S. Cl.
USPC ..... 271/264; 271/1; 347/164

(58) Field of Classification Search ..... 271/1, 264; 347/2, 4, 164; 346/137; 720/601, 603, 613
See application file for complete search history.

(56) References Cited

U.S. PATENT DOCUMENTS 7,101,096 B2 * 9/2006 Sasai et al. ..... 400/48
7,591,552 B2 * 9/2009 Takeshita et al. ..... 347/104
8,152,295 B2 * 4/2012 Komuro et al. ..... 347/104
2006/0170750 A1 * 8/2006 Takeshita et al. ..... 347/104
2006/0181566 A1 * 8/2006 Miyashita et al. ..... 347/20
2009/0295896 A1 * 12/2009 Komuro et al. ..... 347/104
2009/0295897 A1 * 12/2009 Komuro et al. ..... 347/104
2009/0322844 A1 * 12/2009 Komuro et al. ..... 347/104
2010/0044947 A1 * 2/2010 Teshigawara et al. ..... 271/3.15
2010/0085407 A1 * 4/2010 Takeshita ..... 347/104
2012/0081760 A1 * 4/2012 Asada et al. ..... 358/471

FOREIGN PATENT DOCUMENTS

JP H09-262968 A 10/1997
JP 2006-327210 A 12/2006

* cited by examiner

*Primary Examiner* — Jeremy R Severson
(74) *Attorney, Agent, or Firm* — Baker Botts L.L.P.

(57) ABSTRACT

An image recording device includes a first roller, a plurality of second rollers, a tray, and a recording portion. The tray includes a pair of thick-walled sections, a thin-walled section, and an accommodation portion. The pair of thick-walled sections extends in a lengthwise direction and protrudes from the first surface. The thin-walled section is positioned between the pair of thick-walled sections. The thin-walled section is thinner than the pair of thick-walled sections in a thickness direction of the tray. The accommodation portion is formed by a recess in the thickness direction in the thin-walled section. When the first roller and the plurality of second rollers nip the tray therebetween, the first surface of the tray does not contact any of the first roller or the plurality of second rollers, except at the pair of thick-walled sections of the tray.

9 Claims, 10 Drawing Sheets

IMAGE RECORDING DEVICE

CROSS REFERENCE TO RELATED APPLICATION

The present application claims priority from Japanese Patent Application No. 2010-211096, which was filed on Sep. 21, 2010, and Japanese Patent Application No. 2011-011139, which was filed on Jan. 21, 2011, the disclosures of which are incorporated herein by reference in their entirety.

BACKGROUND

1. Field of the Invention

The present invention relates to an image recording device that uses a pair of rollers to nip and convey a tray and that records an image on a recording medium set on the tray.

2. Description of the Related Art

An image recording device that uses a pair of rollers to nip and convey a tray having the shape of a thin plate is known. In the image recording device, a thick recording medium, such as a CD or a DVD, is set on a dedicated tray. The tray is conveyed within the image recording device, and an image is recorded onto the recording medium.

In such an image recording device, the midsection of the tray is bent by the force from the driving roller and the driven roller for nipping the tray. The tray or the CD or DVD comes into contact with the driving roller or a recording head.

SUMMARY OF THE INVENTION

A need has arisen to provide an image recording device capable of preventing the recording medium disposed on the tray from coming into contact with the driving roller or the recording head.

According to an embodiment of the present invention, an image recording device comprising: a first roller, a plurality of second rollers, a plate-like tray, and a recording portion. The first roller is configured to rotate by receiving a driving force from a driving source. The plurality of second rollers are arranged in an axial direction of the first roller. The plate-like tray has a first surface configured to hold a recording medium. The first roller and the plurality of second rollers are configured to nip the tray between the first roller and the plurality of second rollers. The recording portion is configured to record an image on the recording medium held in the tray. The tray comprises: a first section disposed at one end of the tray and a second section disposed at the other end of the tray in a widthwise direction parallel to the axial direction of the first roller. The first and the second sections extend in a lengthwise direction orthogonal to the widthwise direction and protrude from the first surface of the tray in a thickness direction perpendicular to the first surface. The tray also comprises a third section positioned between the first and the second sections, wherein the third section is thinner in the thickness direction than each of the first and the second sections. The tray further comprises an accommodation portion formed by a recess in the third section and configured to accommodate the recording medium. When the first roller and the plurality of second rollers nip the tray therebetween, the first surface of the tray does not contact any of the first roller or the plurality of second rollers, except at the first and the second sections of the tray.

DESCRIPTION OF THE PREFERRED EMBODIMENT

An embodiment according to the present invention is described below with reference to the drawings. The embodiment described below is merely an example of the present invention, and modifications of this embodiment of the present invention are permissible, where appropriate, so long as the modifications do not depart from the spirit of the invention.

Multi-Function Device 10

Figure 1:
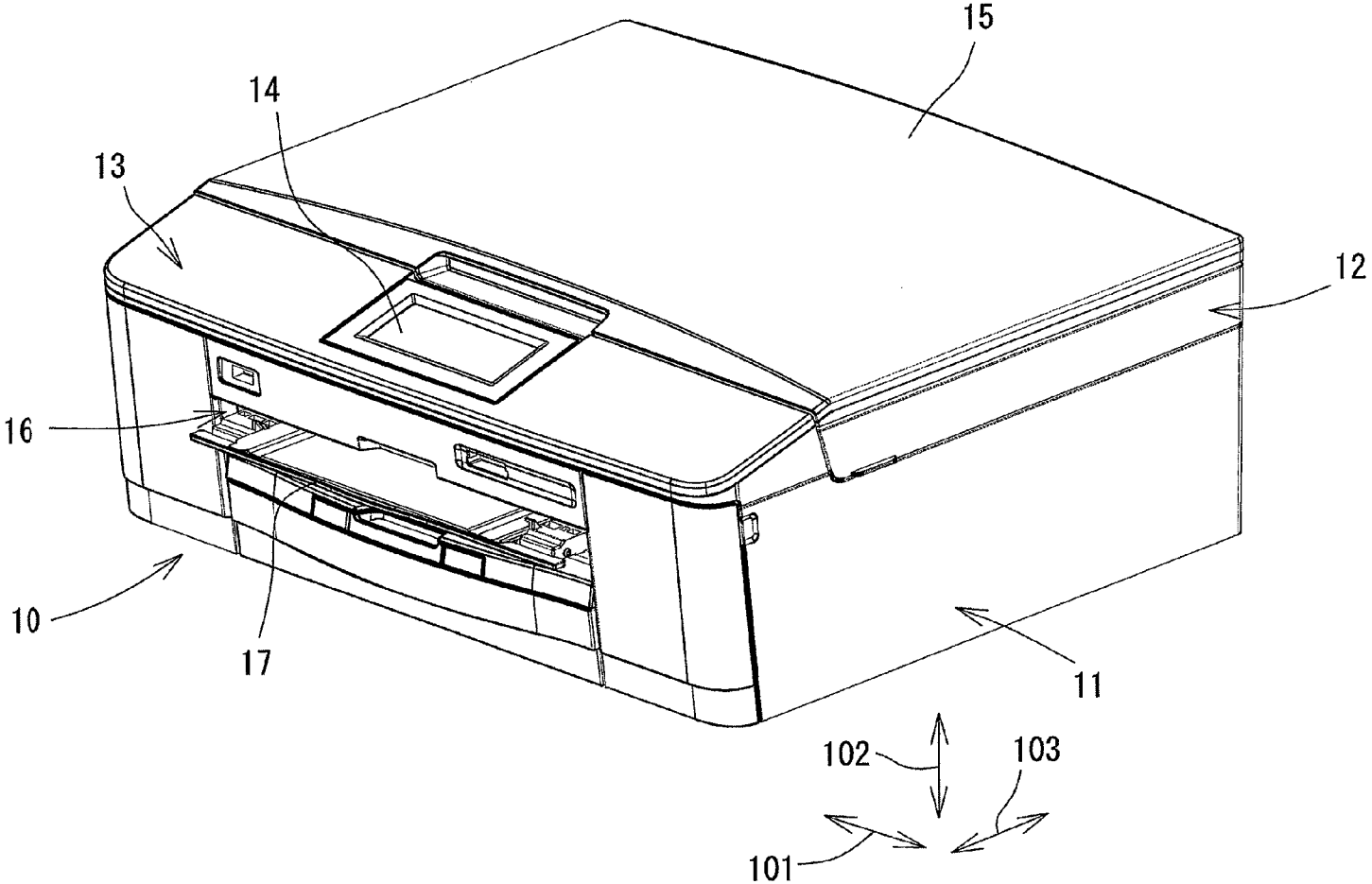
FIG. 1 is a perspective view depicting a multi-function device which is an example of an embodiment of the present invention.

Referring to FIG. 1, a multi-function device (MFD) 10 integrally includes a printer unit 11 disposed at a lower section and a scanner unit 12 disposed thereon. The multi-function device 10 has a printing function, a scanning function, a copying function, a facsimile function, and the like. In this embodiment, in FIG. 1, an arrow 101 denotes a width direction (left-right direction) of the multi-function device 10, an arrow 102 denotes a height direction (vertical direction) of the multi-function device 10, and an arrow 103 denotes a depth direction (front-rear direction) of the multi-function device 10. It should be noted that the scanning function, the facsimile function, and the like are optional functions. For example, an image recording device may be a printer only having a printing function.

A control panel 13 for operating the printer unit 11 and the scanner unit 12 is provided at a front upper surface of the multi-function device 10, more specifically, at a front upper surface of the scanner unit 12. The control panel 13 includes various control buttons and a liquid-crystal display 14. In response to an input from the control panel 13, the multi-function device 10 operates on the basis of a command from a controller (not shown) that controls the overall operation of the multi-function device 10. If the multi-function device 10 is connected to a computer, the multi-function device 10 also operates on the basis of a command sent from the computer via a printer driver, a scanner driver, or the like.

The scanner unit 12 is a so-called flatbed scanner. A document cover 15 serving as a top plate of the multi-function device 10 is provided in an openable-closable manner on top of the scanner unit 12. A platen glass and an image sensor (not shown) are provided below the document cover 15. An image of an original document placed on the platen glass is read by the image sensor. Because the scanner unit 12 is not directly involved with the achievement of the present invention, a detailed description of the scanner unit 12 is omitted here.

Figure 2:
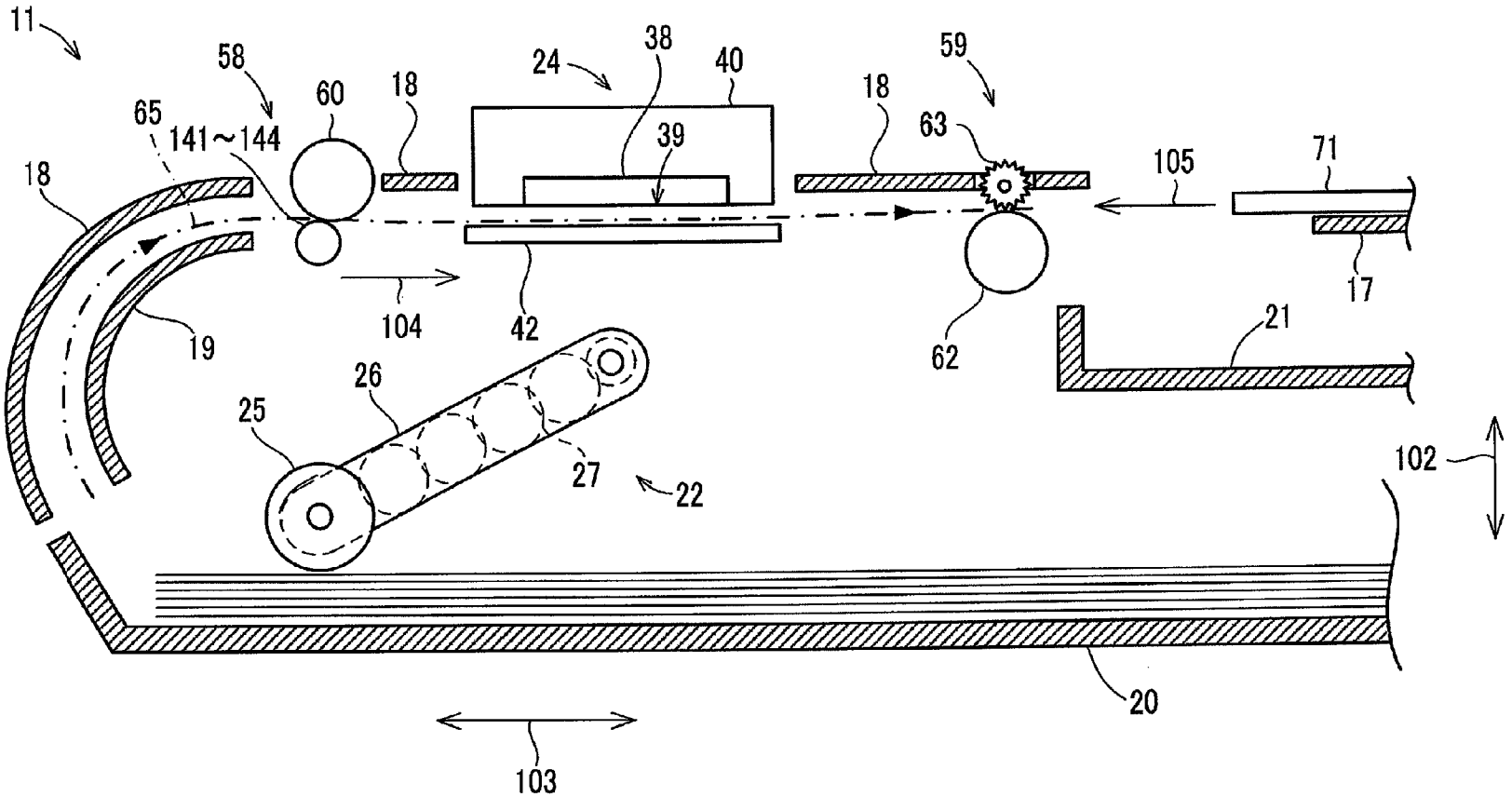
FIG. 2 is a longitudinal sectional view schematically depicting an internal structure of a printer unit.

Referring to FIG. 2, the printer unit 11 includes a feeder 22 that feeds a recording sheet and an inkjet-recording-type recorder 24 that records an image onto the recording sheet. The printer unit 11 records an image on the recording sheet on the basis of print data or the like received from an external device. The multi-function device 10 also has a function of recording an image on a surface of a recording medium, such as a CD-ROM or a DVD-ROM, that is thicker than a recording sheet by using the recorder 24.

The multi-function device 10 has a conveying path 65. The conveying path 65 curves upward and toward the front surface of the multi-function device 10 from a rear side of a feed tray 20 and then extends below the recorder 24 from the rear surface toward the front surface of the multi-function device 10 so as to connect to an output tray 21. The recording sheet is conveyed along the conveying path 65 in a conveying direction indicated by an arrow 104. The conveying path 65 is defined mainly by an outer guide member 18 and an inner guide member 19 that face each other with a predetermined distance therebetween.

The feeder 22 is provided above the feed tray 20. The feeder 22 includes a feed roller 25, a feed arm 26, and a drive transmission mechanism 27. The feed roller 25 is rotatably supported at an end of the feed arm 26 that is pivotable into and out of contact with the feed tray 20. The feed roller 25 rotates by receiving a driving force of a feed motor (not shown) via the drive transmission mechanism 27 comprising multiple meshed gears. The feed roller 25 feeds an uppermost recording sheet from recording sheets stacked on the feed tray 20 to the conveying path 65.

The recorder 24 is provided above the conveying path 65 extending from the rear surface toward the front surface of the multi-function device 10. The recorder 24 includes a carriage 40 that holds a recording head 38 and that reciprocates in the main scanning direction (i.e., the width direction 101 which is orthogonal to the plane of the drawing in FIG. 2). The recording head 38 is supplied with ink from an ink cartridge (not shown). The recording head 38 ejects ink as small ink droplets from nozzles 39. A platen 42 supports the recording sheet. The carriage 40 reciprocates in the main scanning direction, so that the recording head 38 is scanned across the recording sheet supported by the platen 42. While the recording head 38 is scanned across the recording sheet, ink droplets are selectively ejected from the nozzles 39. The ink droplets land on the recording sheet, whereby a desired image is recorded on the recording sheet.

Pair of Conveying Rollers 58 And Pair of Discharge Rollers 59

Referring to FIG. 2, a pair of conveying rollers 58 constituted of a conveying roller 60 and pinch rollers 141, 142, 143, and 144 is disposed upstream of the recorder 24 in the conveying direction 104. The conveying roller 60 is disposed above the conveying path 65. The pinch rollers 141, 142, 143, and 144 are disposed below the conveying path 65. The conveying roller 60 is disposed facing the pinch rollers 141, 142, 143, and 144 substantially in the height direction 102.

Figure 3:
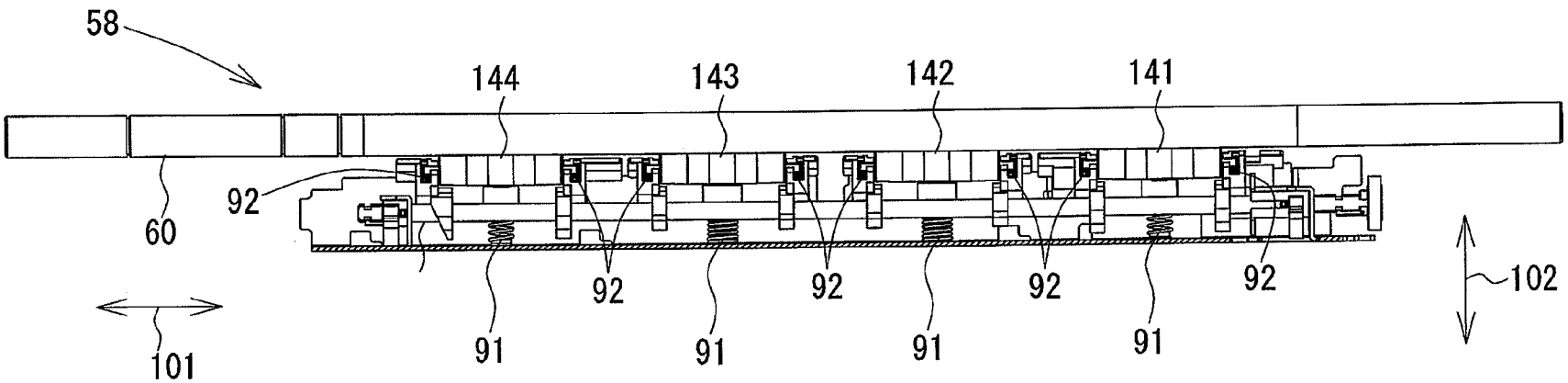
FIG. 3 is a front view depicting a pair of conveying rollers.

Although not expressed in the drawings, the conveying roller 60 is supported rotatably by frames (not shown) of the printer unit 11 that are provided at left and right sides of the conveying path 65. Referring to FIG. 3, the conveying roller 60 is a single narrow cylindrical roller with its axis extending in the width direction 101. One end of the conveying roller 60 is provided with a gear (not shown). A driving force transmitted from a conveying motor (not shown) to this gear rotates the gear, causing the conveying roller 60 to rotate. The conveying roller 60 is rotatable in both forward and reverse directions in accordance with the rotational direction of the conveying motor.

As shown in FIG. 3, the pinch rollers 141, 142, 143, and 144 are disposed, such that the axes thereof extend in the width direction 101. The pinch rollers 141, 142, 143, and 144 are arranged separate from each other in the width direction 101. Regarding each of the pinch rollers 141 to 144, the left and right axial ends thereof are supported rotatably. Moreover, each pinch roller is supported in a movable manner in the height direction 102. Therefore, the pinch rollers 141 to 144 are movable into and out of contact with the conveying roller 60. Furthermore, each of the pinch rollers 141 to 144 is biased toward the conveying roller 60 by a coil spring 91 and coil springs 92.

As shown in FIG. 2, a pair of conveying rollers 59 constituted of a discharge roller 62 and a spur 63 is disposed downstream of the recorder 24 in the conveying direction 104. The discharge roller 62 is disposed below the conveying path 65. The spur 63 is disposed above the conveying path 65. The discharge roller 62 and the spur 63 are disposed facing each other substantially in the height direction 102. Although not expressed in the drawings, the spur 63 is supported in a movable manner so as to be movable into and out of contact with the discharge roller 62, and is biased toward the discharge roller 62 by a coil spring or the like. The pair of discharge rollers 59 nips the recording sheet and conveys the recording sheet toward the output tray 21.

Medium Tray 71

The configuration of a medium tray 71 is described below. The multi-function device 10 has the function of recording an image on a face of a recording medium. If an image is to be recorded on a face of a recording medium, the recording medium is disposed on the medium tray 71. While being placed on a tray guide 17, the medium tray 71 is inserted in an insertion direction 105, which is the reverse direction of the conveying direction 104, along the conveying path 65 through an opening 16.

Figure 4:
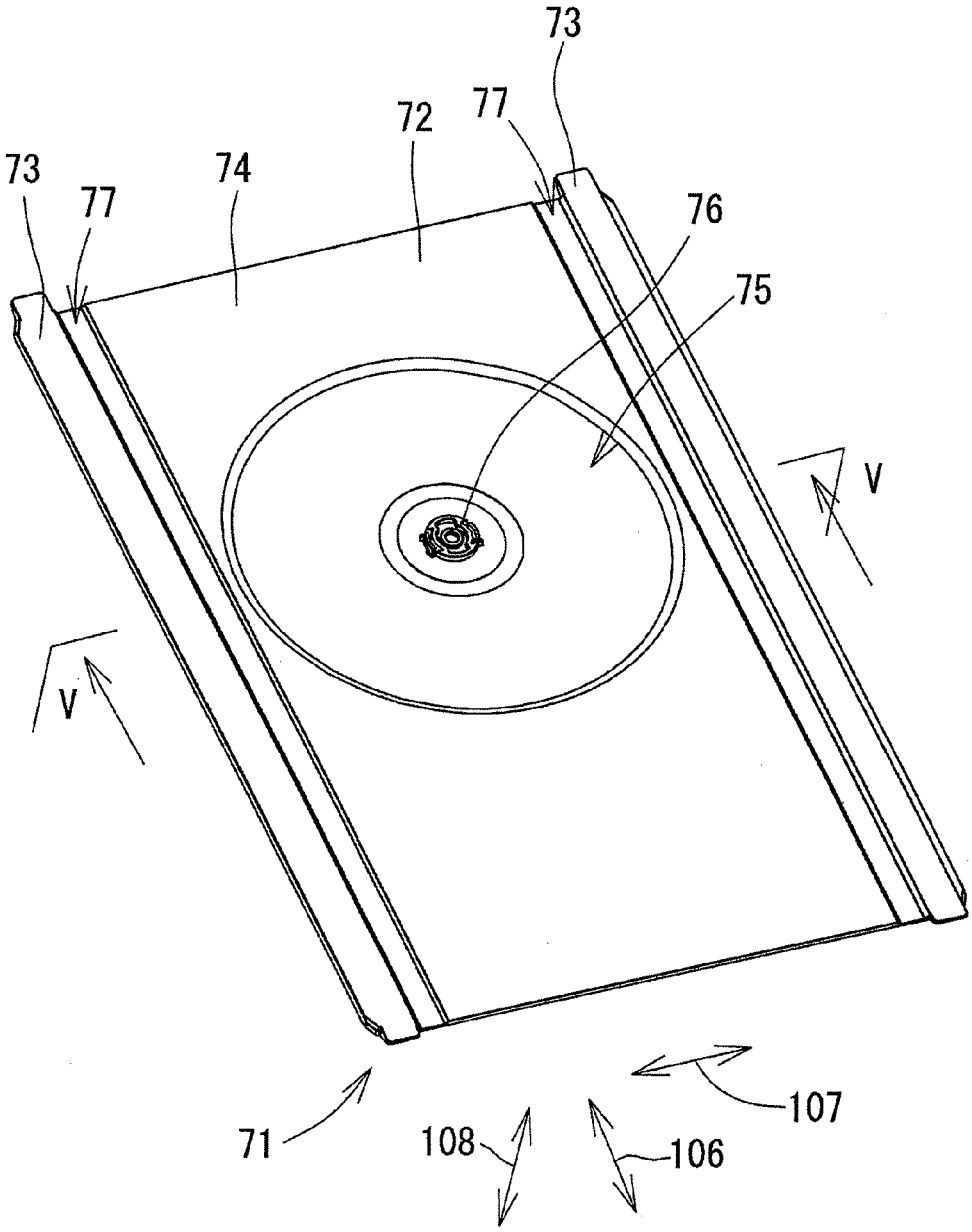
FIG. 4 is a perspective view depicting a medium tray.
Figure 5:
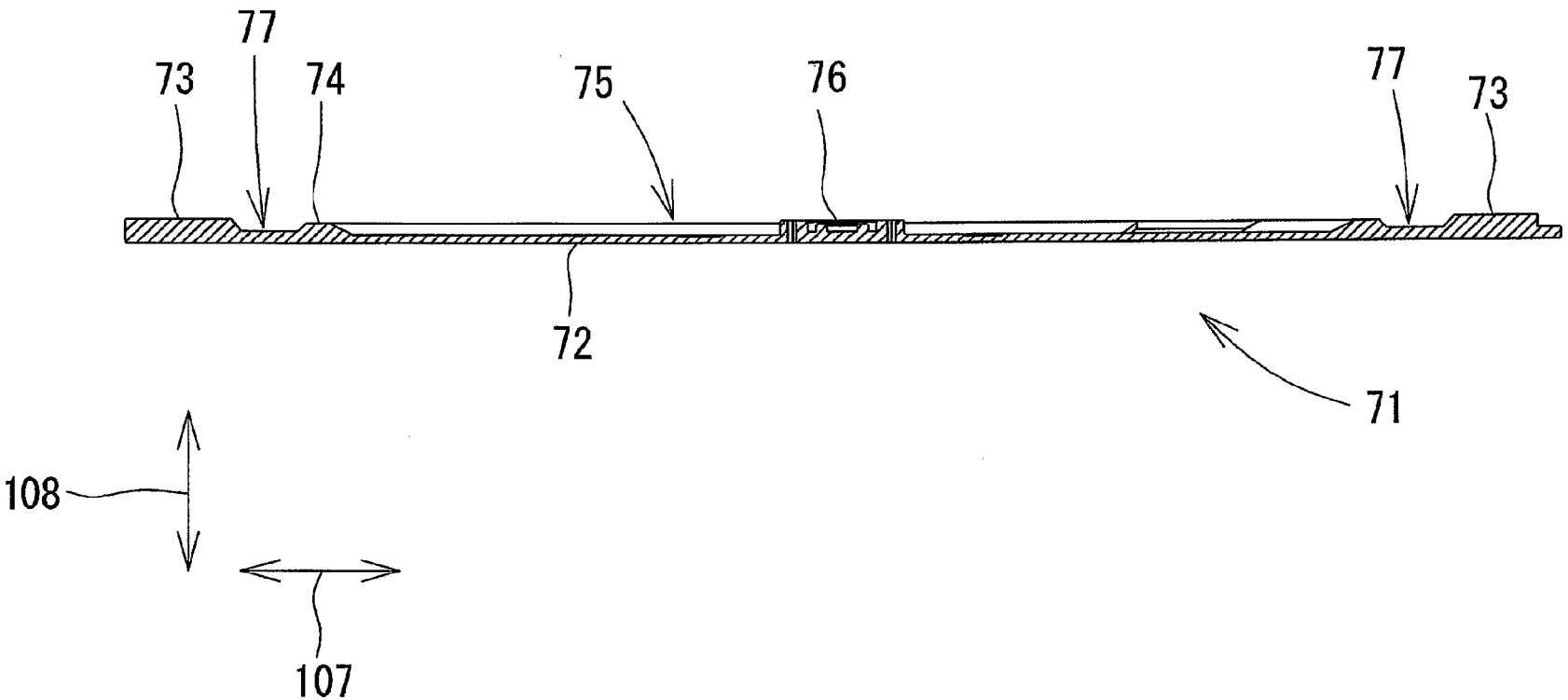
FIG. 5 is a cross-sectional view taken along line V-V in FIG. 4.

Referring to FIGS. 4 and 5, the medium tray 71 has substantially a plate-like shape. In a state in which the medium tray 71 is positioned to be inserted into the multi-function device 10, a longitudinal direction 106 (lengthwise direction) extends parallel to the insertion direction 105, that is, the depth direction 103, and a lateral direction 107 (widthwise direction) extends parallel to the direction orthogonal to the insertion direction 105, that is, the width direction 101. The lateral direction 107 is aligned with the axial direction of the conveying roller 60 in the state in which the medium tray 71 is positioned to be inserted into the multi-function device 10.

The medium tray 71 has a thin-walled section 72 in a midsection thereof in the lateral direction 107, and thick-walled sections 73 extending respectively along opposite edges of the medium tray 71 in the lateral direction 107. The thin-walled section 72 and the thick-walled sections 73 have different thicknesses in a thickness direction 108, which is orthogonal to the longitudinal direction 106 and the lateral direction 107. Specifically, the thin-walled section 72 is thinner than the thick-walled sections 73. The thin-walled section 72 and the thick-walled sections 73 each have a fixed thickness except for areas where an accommodation portion 75 and grooves 77, as described below, are formed.

The thin-walled section 72 extends in the longitudinal direction 106 in the midsection of the medium tray 71 in the lateral direction 107. The thin-walled section 72 has an upper surface (first surface) 74 that faces upward in FIGS. 4 and 5.

The thin-walled section 72 is provided with the accommodation portion 75 that is depressed from the upper surface 74. The accommodation portion 75 is a circular depression that is slightly larger in size than the recording medium. A projection 76 is provided in the center of the circular accommodation portion 75. A hole formed in the center of the recording medium is fitted around the projection 76. Thus, the recording medium is positioned and supported by the accommodation portion 75. The depth of the accommodation portion 75 is determined in view of the thicknesses of various kinds of recording media, such that the upper surface of the recording medium supported by the accommodation portion 75 does not protrude above the thick-walled sections 73 of the medium tray 71.

The thick-walled sections 73 extend in the longitudinal direction 106 respectively along the opposite edges of the medium tray 71 in the lateral direction 107. Each of the thick-walled sections 73 protrudes above the upper surface 74 of the thin-walled section 72. When the medium tray 71 is inserted into the multi-function device 10, as described below, the pair of conveying rollers 58 nips the thick-walled sections 73.

The medium tray 71 has the grooves 77 respectively formed at the outer sides of the accommodation portion 75 of the thin-walled section 72 in the lateral direction 107. The grooves 77 are disposed near the boundaries between the thin-walled section 72 and the thick-walled sections 73. The grooves 77 extend in the longitudinal direction 106 and are depressed in the thickness direction 108 from the upper surface 74.

Recording of Image Onto Recording Medium

A procedure for inserting the medium tray 71 into the multi-function device 10 and recording an image onto the recording medium disposed on the medium tray 71 are described below. As shown in FIG. 1, the tray guide 17 is pulled out by a user through the opening 16 in the front surface of the multi-function device 10. The user may dispose the recording medium in the accommodation portion 75 of the medium tray 71 and insert the medium tray 71 in the insertion direction 105 while placing the medium tray 71 on the tray guide 17. The medium tray 71 is inserted into the conveying path 65 through the opening 16 until the leading end of the inserted medium tray 71 reaches the conveying roller 60 via the pair of conveying rollers 59. Accordingly, the insertion process of the medium tray 71 is completed.

When a command for recording an image onto the recording medium is input to the control panel 13 or when the command is received from an external device, the multi-function device 10 rotates the conveying roller 60 and the discharge roller 62, so that the medium tray 71 is conveyed further in the insertion direction 105. Specifically, the conveying roller 60 and the discharge roller 62 are driven rotationally in the reverse direction of the conveying direction 104.

Although not depicted in the drawings, when the medium tray 71 is inserted, the multi-function device 10 may be configured to move the platen 42, the discharge roller 62, and the pinch rollers 141 to 144 downward in accordance with the thickness of the medium tray 71.

Figure 6:
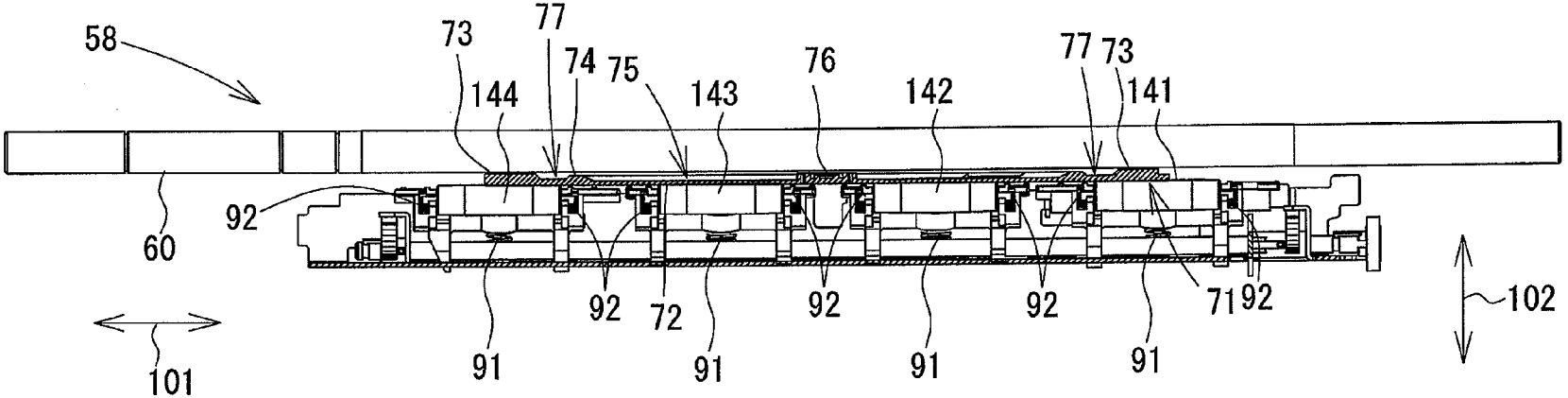
FIG. 6 is a front view depicting the pair of conveying rollers conveying the medium tray.

Referring to FIG. 6, when the conveying roller 60 is rotationally driven, the leading end of the medium tray 71 becomes nipped between the pair of conveying rollers 58. Thus, the pinch rollers 141 to 144 move downward, that is, away from the conveying roller 60, against the bias force of the coil springs 91 and 92. While nipping the medium tray 71, the pair of conveying rollers 58 conveys the medium tray 71 in the insertion direction 105 to a predetermined position due to the rotation of the conveying roller 60. This predetermined position corresponds to where the accommodation portion 75 of the medium tray 71 is positioned toward the rear side of the device relative to the area below the recording head 38. Consequently, the recording medium set in the accommodation portion 75 is inserted to the rear side of the device relative to the recording head 38. In FIG. 6, the recording medium accommodated in the medium tray 71 is not shown.

After the medium tray 71 is inserted in the insertion direction 105 to the predetermined position by the pair of conveying rollers 58, the rotation of the conveying roller 60 and the discharge roller 62 is switched from the reverse direction to the forward direction. Thus, the medium tray 71 is conveyed in the conveying direction 104. When the recording medium disposed on the medium tray 71 is conveyed to a position directly below the recording head 38, the conveying roller 60 and the discharge roller 62 are stopped temporarily from rotating. While the rotation of the conveying roller 60 and the discharge roller 62 is stopped temporarily, the carriage 40 holding the recording head 38 is moved in the width direction 101. Specifically, the recording head 38 is scanned across the recording medium. During this scanning process, ink droplets are ejected selectively onto the recording medium from the recording head 38. The ejected ink droplets land on the face of the recording medium. When the movement of the carriage 40 is completed, the conveying roller 60 and the discharge roller 62 are rotated by an amount equivalent to a predetermined conveying distance, and are stopped again. Specifically, the conveying roller 60 and the discharge roller 62 are rotated intermittently with temporarily stop periods in-between. While the conveying roller 60 and the discharge roller 62 are stopped temporarily, the carriage 40 is moved in the same manner as described above. During the movement of the carriage 40, ink droplets are selectively ejected from the recording head 38 and land on the face of the recording medium. By repeating this process, a desired image is recorded on the recording medium. After the desired image is recorded on the recording medium, the conveying roller 60 and the discharge roller 62 are rotated continuously, thereby discharging the medium tray 71 outward from the front surface of the device.

When the medium tray 71 is nipped and conveyed by the pair of conveying rollers 58, as described above, the thick-walled sections 73 of the medium tray 71 are nipped between the conveying roller 60 and the pinch rollers 141 and 144, as depicted in FIG. 6. Since the thick-walled sections 73 protrude higher than the upper surface 74 of the thin-walled section 72, the conveying roller 60 does not come into contact with the upper surface 74 of the thin-walled section 72 when the thick-walled sections 73 are nipped between the conveying roller 60 and the pinch rollers 141 and 144, thereby reducing the biasing force from the pinch rollers 142 and 143 from being applied to the conveying roller 60 via the thin-walled section 72.

Advantages of Present Embodiment

As described above, because the thick-walled sections 73 of the medium tray 71 protrude higher than the upper surface 74 of the thin-walled section 72, even if the thin-walled section 72 is pressed and slightly bent toward the conveying roller 60 by the pinch rollers 142 and 143, a gap between the upper surface 74 of the thin-walled section 72 and the conveying roller 60 reduces the recording medium accommodated in the accommodation portion 75 from coming into contact with the conveying roller 60. In addition, because a gap also is formed between the upper surface 74 of the thin-walled section 72 and the recording head 38, the medium tray 71 and the recording medium accommodated in the accommodation portion 75 of the medium tray 71 are reduced from coming into contact with the recording head 38.

Because the upper surface 74 of the thin-walled section 72 does not come into contact with the conveying roller 60 when the medium tray 71 is conveyed by the pair of conveying rollers 58, the biasing force from the pinch rollers 141 to 144 is not transmitted to an area in the conveying roller 60 that corresponds to the thin-walled section 72, that is, a midsection of the conveying roller 60 in the axial direction. Accordingly, the amount of bowing of the conveying roller 60 is minimized even if the biasing force of the coil springs 91 and 92 that bias the pinch rollers 141 to 144 is increased.

Figure 7:
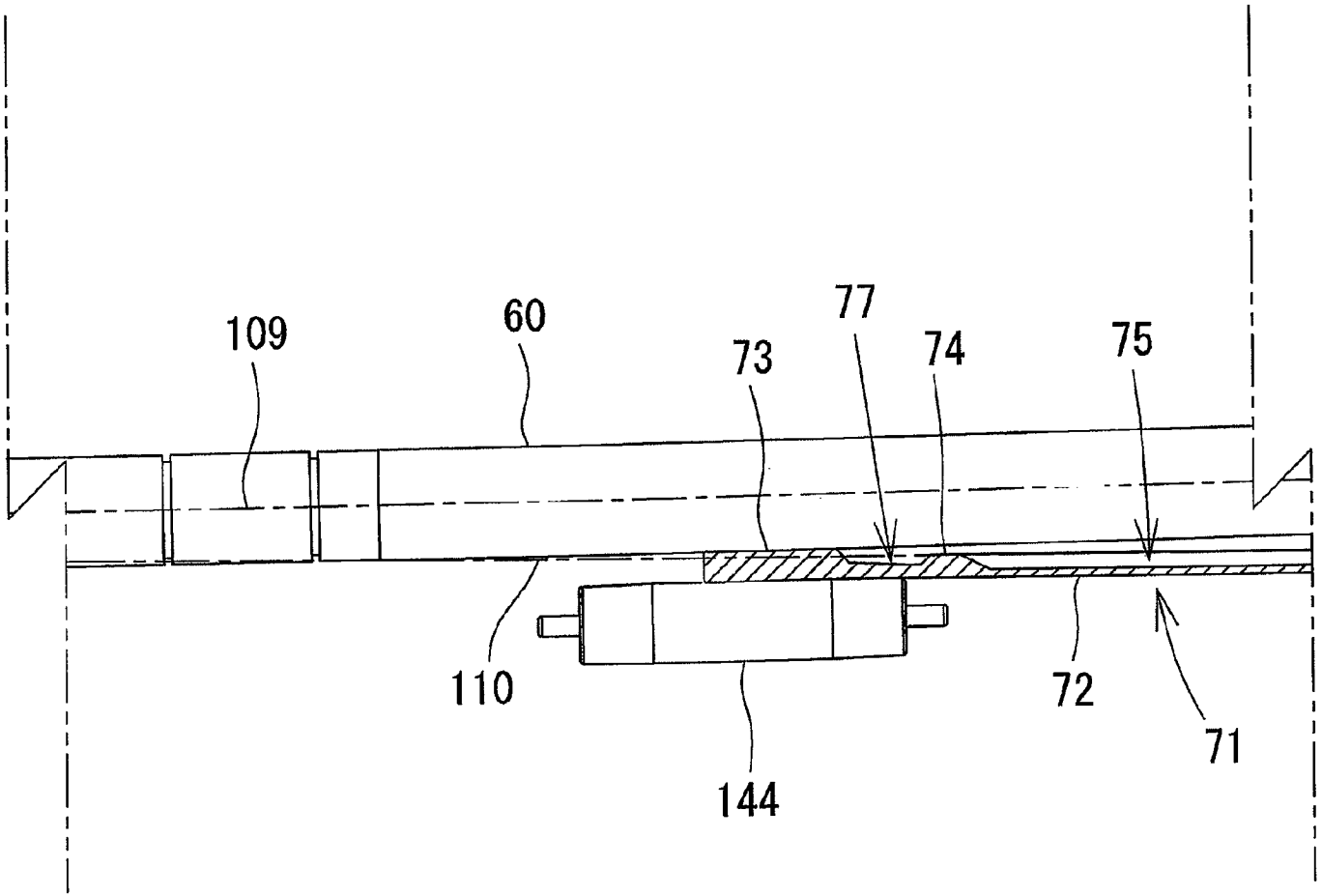
FIG. 7 is a partial cross-sectional view depicting the medium tray and one of the conveying rollers in a bowed state.

Furthermore, supposing that an axis 109 of the conveying roller 60 is bowed relative to a horizontal direction 110 (i.e., the width direction 101), as shown in FIG. 7, each of the grooves 77 in the medium tray 71 causes the outer side and the inner side of the groove 77 relative to the thin-walled section 72 to bend. Specifically, the outer side of the groove 77, that is, the corresponding thick-walled section 73 side, conforms to the bowed conveying roller 60, such that the upper surface of the outer side of the groove 77 extends along the bowed axis 109. On the other hand, the inner side of the groove 77, that is, the side of the thick-walled section 73 adjacent to the accommodation portion 75, does not conform to the bowed conveying roller 60 such that the upper surface 74 extends parallel to the horizontal direction 110 (i.e., the width direction 101). Accordingly, even when the conveying roller 60 is bowed, a fixed head gap is maintained between the recording medium accommodated in the accommodation portion 75 and the recording head 38. FIG. 7 depicts a state in which the midsection of the conveying roller 60 is bowed upward, that is, the right side of the conveying roller 60 in the drawing is bowed upward.

First Modification

Although the grooves 77 in the medium tray 71 are formed at the outer sides in the lateral direction 107 relative to the accommodation portion 75 of the thin-walled section 72 in the above-described embodiment, the positions of the grooves 77 are changeable.

Figure 8:
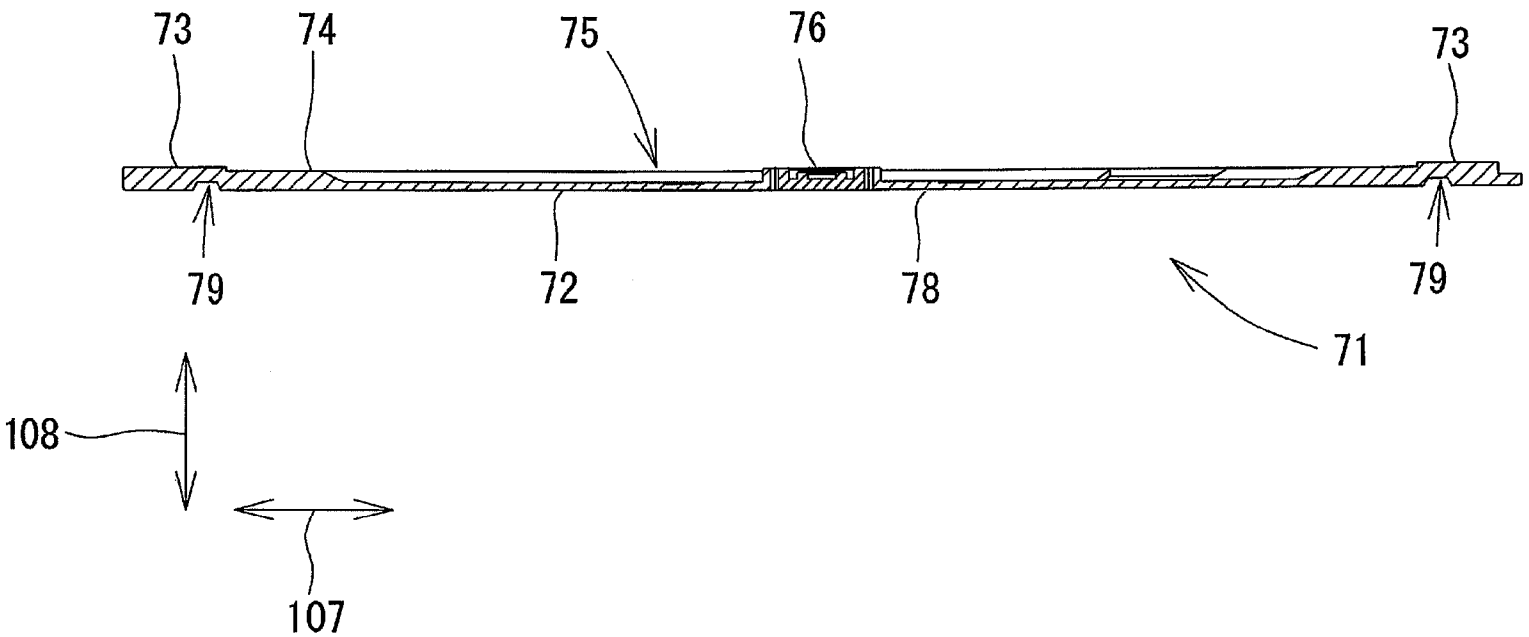
FIG. 8 is a cross-sectional view depicting a medium tray according to a first modification.

For example, referring to FIG. 8, grooves 79 may be formed in a lower surface 78 opposite the upper surface 74 of the thick-walled sections 73. Specifically, the grooves 79 are formed at the inner sides, in the width direction 101, of positions of the thick-walled sections 73 to be nipped between the conveying roller 60 and the pinch rollers 141 and 144. Each groove 79 extends in the longitudinal direction 106 and is depressed in the thickness direction 108 from the lower surface 78.

Like the above-described embodiment, even when the axis 109 of the conveying roller 60 is bowed relative to the horizontal direction 110 (i.e., the width direction 101), each of the grooves 79 causes only the outer side of the groove 79 in the width direction 101 to extend along the bowed axis 109, whereby a fixed head gap is maintained between the recording medium accommodated in the accommodation portion 75 and the recording head 38. Furthermore, the same advantages are achieved whether the grooves 77 or 79 are disposed in the upper surface 74 or the lower surface 78 of the medium tray 71.

Second Modification

Although the conveying roller 60 is disposed above the conveying path 65, and the pinch rollers 141 to 144 are disposed below the conveying path 65 in the above-described embodiment, the positions of these components are changeable. For example, referring to FIG. 9, a conveying roller 61 may be disposed below the conveying path 65, and pinch rollers 145 to 148 may be disposed above the conveying path 65.

Figure 9:
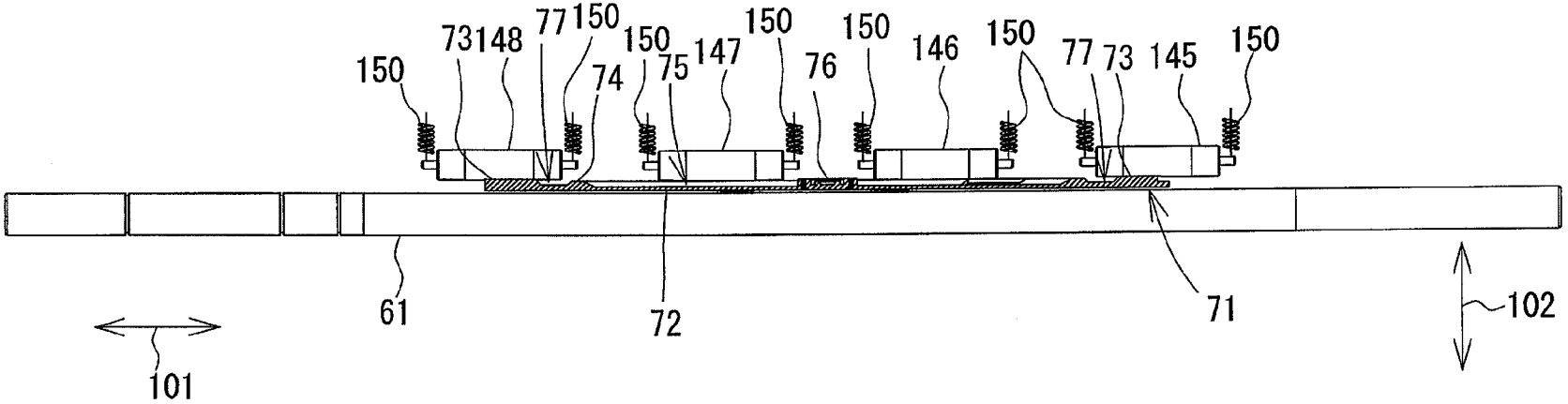
FIG. 9 is a front view depicting a conveying roller and pinch rollers according to a second modification.

As shown in FIG. 9, among the pinch rollers 145 to 148, the pinch rollers 146 and 147 that come into contact with the thin-walled section 72 of the medium tray 71 are moved more toward the conveying roller 61 than the pinch rollers 145 and 148 that come into contact with the thick-walled sections 73. Accordingly, coil springs 150 that bias the pinch rollers 146 and 147 expand longer than coil springs 150 that bias the pinch rollers 145 and 148, so that the bias force received from the coil springs 150 by the pinch rollers 146 and 147 is relatively weaker. As a result, a pressing force applied by the pinch rollers 146 and 147 to the conveying roller 61 via the thin-walled section 72 is weaker, thereby minimizing the amount of downward bowing of the midsection of the conveying roller 61.

Third Modification

Figure 10:
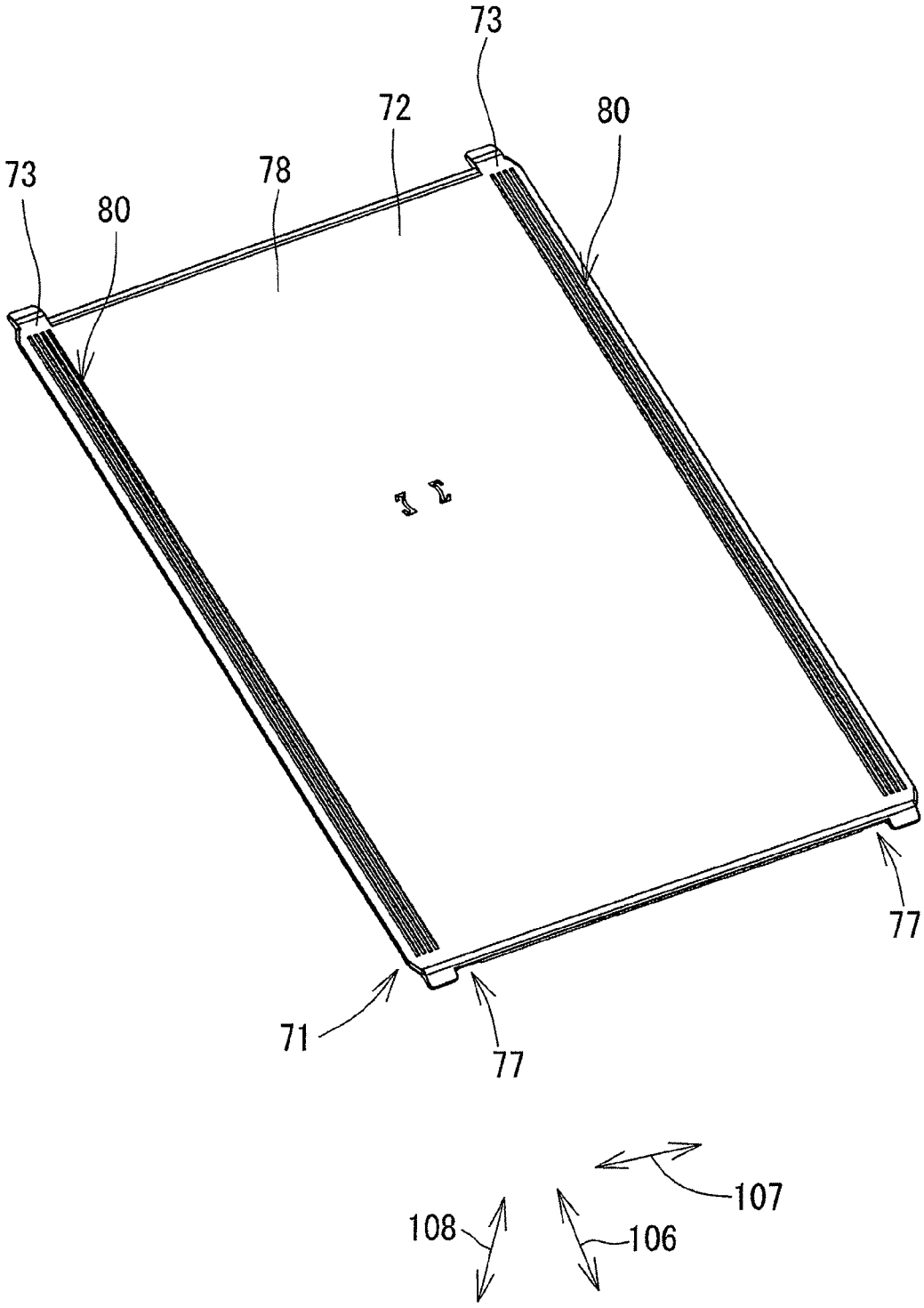
FIG. 10 is a perspective view depicting a lower surface of a medium tray according to a third modification.

Referring to FIG. 10, the lower surface 78 of the aforementioned medium tray 71 may be provided with grooves 80 at positions corresponding to the thick-walled sections 73. Specifically, multiple grooves 80 are arranged in the lateral direction 107 at the position corresponding to each thick-walled section 73. In this modification, each thick-walled section 73 is provided with four grooves 80, but the number of grooves 80 may be two or more. The grooves 80 have the same shape, extend in the longitudinal direction 106, and are depressed in the thickness direction 108 from the lower surface 78.

By providing each thick-walled section 73 with a plurality of grooves 80, the amount of bending of the thick-walled section 73 in the lateral direction 107 is minimized. Moreover, because the contact area between the thick-walled sections 73 and the conveying roller 60 is not reduced, a fluctuation in the driving force transmitted to the thick-walled sections 73 from the conveying roller 60 does not occur. Accordingly, the medium tray 71 may be conveyed accurately.

What is claimed is:

1. An image recording device comprising:

a first roller configured to rotate by receiving a driving force from a driving source;

a plurality of second rollers arranged in an axial direction of the first roller;

a plate-like tray having a first surface configured to hold a recording medium, wherein the first roller and the plurality of second rollers are configured to nip the tray between the first roller and the plurality of second rollers; and a recording portion configured to record an image on the recording medium held in the tray, wherein the tray comprises:

a first section disposed at one end of the tray and a second section disposed at the other end of the tray in a widthwise direction parallel to the axial direction of the first roller, wherein the first and the second sections extend in a lengthwise direction orthogonal to the widthwise direction and protrude from the first surface of the tray in a thickness direction perpendicular to the first surface;

a third section positioned between the first and the second sections, wherein the third section is thinner in the thickness direction than each of the first and the second sections; and an accommodation portion formed by a recess in the third section and configured to accommodate the recording medium;

wherein, when the first roller and the plurality of second rollers nip the tray therebetween, the first surface of the tray does not contact any of the first roller or the plurality of second rollers, except at the first and the second sections of the tray.

2. The image recording device according to claim 1, wherein the tray further comprises a first groove and a second groove formed by recess in the thickness direction in the third section and extending in the lengthwise direction and, wherein the first groove is arranged between the first section and the third section in the widthwise direction and the second groove is arranged between the second section and the third section in the widthwise direction.

3. The image recording device according to claim 2, wherein the first groove and the second groove are formed in a second surface of the tray opposite to the first surface.

4. The image recording device according to claim 1, wherein at least one of the plurality of second rollers is configured to contact the tray when the tray is nipped between the first roller and the plurality of second rollers.

5. The image recording device according to claim 1, further comprising an urging member configured to urge the plurality of second rollers toward the first roller.

6. The image recording device according to claim 1, wherein the first roller contacts the first surface of the tray.

7. The image recording device according to claim 1, wherein the plurality of second rollers contact the first surface of the tray.

8. The image recording device according to claim 1, wherein the tray has a plurality of third grooves formed by recess in a second surface of the tray opposite to the first surface, wherein the third grooves extend in the lengthwise direction and are arranged at positions corresponding to the first and the second sections.

9. An image recording device comprising:

a tray configured to hold a recording medium on a first surface of the tray;

a recording portion configured to record an image on the recording medium held on the tray;

a first roller; and a second roller, wherein the first roller and the second roller are configured to nip and convey the tray;

wherein the tray comprises:

a thick-walled section disposed at one end and the other end of the tray in a widthwise direction parallel to the axial direction of the first roller, the thick-walled section extends in a lengthwise direction orthogonal to the widthwise direction and protrudes from the first surface of the tray in a thickness direction perpendicular to the first surface;

a thin-walled section disposed at an inner side of the tray from the thick-walled section in the widthwise direction and extending in the lengthwise direction, wherein the thin-walled section is thinner in the thickness direction than the thick-walled section; and an accommodation portion formed by a recess in the thin-walled section and configured to accommodate the recording medium, wherein, when the first roller and the second roller nip the tray therebetween, the first surface of the tray does not contact the first roller or the second roller, except at the thick-walled section of the tray.

* * * * *